US008192340B2

(12) United States Patent
Krieger et al.

(10) Patent No.: US 8,192,340 B2
(45) Date of Patent: Jun. 5, 2012

(54) BUCKLE PLATE DEVICE

(75) Inventors: Eberhard Krieger, Weinstadt-Struempfelbach (DE); Klaus Stoeckel, Korb (DE); Wolfgang Fischer, Leipzig (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 660 days.

(21) Appl. No.: 12/364,733

(22) Filed: Feb. 3, 2009

(65) Prior Publication Data

US 2009/0200727 A1 Aug. 13, 2009

(30) Foreign Application Priority Data

Feb. 7, 2008 (DE) ..... 10 2008 007 965

(51) Int. Cl.
*B31B 1/00* (2006.01)
*B31F 1/00* (2006.01)

(52) U.S. Cl. ..... 493/420; 493/419; 493/23

(58) Field of Classification Search ..... 493/14, 493/23, 419, 420
See application file for complete search history.

(56) References Cited

U.S. PATENT DOCUMENTS

| | | | | |
|---|---|---|---|---|
| 5,352,177 | A * | 10/1994 | Walter | 493/23 |
| 5,377,965 | A * | 1/1995 | Mandel et al. | 270/37 |
| 6,086,522 | A * | 7/2000 | Hechler | 493/23 |

FOREIGN PATENT DOCUMENTS

| | | | |
|---|---|---|---|
| DE | 81125 | A1 | 4/1971 |
| DE | 2427850 | A1 | 12/1975 |
| DE | 2757182 | A1 | 6/1979 |
| DE | 20103900 | U1 | 6/2001 |
| EP | 0252751 | A1 | 1/1988 |
| EP | 0844205 | A1 | 5/1998 |

* cited by examiner

*Primary Examiner* — Kaitlin Joerger
(74) *Attorney, Agent, or Firm* — Rothwell, Figg, Ernst & Manbeck, P.C.

(57) ABSTRACT

A buckle plate device for a folding machine comprises a buckle plate (10) and a sheet stopping means for stopping a sheet (24) running into the buckle plate (10) in the intake direction, wherein the sheet stopping means is formed by a clamping means (26) which clamps the incoming sheet (24) in order to stop it and preferably automatically releases the clamping at the onset of tractive forces of the subsequent rollers. Hereby a buckle plate device is provided which requires little space and makes it possible to fold sheets with comparably low noise development without a mechanical stop in a sheet-edge controlled manner or in a print-image controlled manner at a high sheet transport speed.

6 Claims, 2 Drawing Sheets

BUCKLE PLATE DEVICE

CROSS REFERENCE TO RELATED APPLICATION(S)

This application claims the benefit of German Application No. DE 102008007965.0, filed Feb. 7, 2008, of which is incorporated by reference in their entirety.

The invention relates to a buckle plate device for a folding machine comprising a buckle plate and sheet stopping means for stopping a sheet running into said buckle plate in an intake direction,.

A buckle plate device of this kind is known, for example, from DE 24 27 850 A1. In the case of this buckle plate device a paper sheet is conveyed by a pair of intake rollers into the buckle plate. In the buckle plate the sheet is conveyed to a mechanical stop the position of which can be adjusted and against which the sheet hits with its leading edge, whereby it is stopped while the sheet end is conveyed further into the folding unit by the intake rollers. Hereby a loop is formed in the folding space. When this loop is big enough, it is grasped by a subsequent pair of rollers and conveyed further into the next buckle plate or conveyed out of the folding unit through sheet guide elements. This solution is the presently prevailing one realized worldwide in folding machines which exclusively or in part fold according to the principle of buckle folding.

Due to ever increasing sheet formats and switching to automated machines, which have, for example, a motor-driven sheet stop adjustment, the buckle plates are becoming very big and heavy. Since they often have to be taken out of the machine wholly or in part for a change of task, they are very difficult to handle. Moreover, due the fact that the sheet transport speeds at the time when the leading edge of a sheet hits against a stop increase more and more, damage or marking of the leading edge of the sheet is increasingly caused. In order to avoid this, sensitive sheets must be processed more slowly. Stop rails which up to now in most cases have been divided are increasingly replaced by continuous stop rails which are costly to produce. The higher the sheet transport speed is, the stronger are the noise pulses produced when the leading edge of a sheet hits against the stop. In order to satisfy noise regulations, therefore elaborate noise protection casings are required to an increasing extent.

Through the mechanical stop the sheets have up to now always been folded with respect to the sheet edge and not with respect to the print image. Variations in the sheet dimensions thus unavoidably lead to variations in the position of the print image on the folded pages.

In order to avoid that the sheets hit against the sheet stop at a high speed, it is known, for example, from EP 0 844 205 A1 to retard the circumferential speed of the intake rollers before the leading edge of a sheet hits against the sheet stop. However, this requires a high level of control and adjustment. In the case of this technology, too, large and unhandy buckle plates have to be used for large sheet formats.

From DE 201 03 900 U1 a buckle plate device is known which, for humidification of extremely dry paper sheets, has a paper moistening means in front of the buckle plate intake, which paper moistening means is moved across the sheet. In order to be able to guarantee sufficient moistening of the paper sheet during the downwardly directed working movement of the paper moistening means, a contact pressure against the end portion of the paper sheet is generated by slightly decelerating the end of the paper sheet having run into the buckle plate by means of a braking means when running out of the buckle plate after having hit against the sheet stop.

The object underlying the invention is to provide a buckle plate device which requires little space and makes it possible to fold sheets with comparably low noise development without a mechanical stop in a sheet-edge controlled manner or in a print-image controlled manner at a high sheet transport speed.

This object is attained by a buckle plate device for a folding machine comprising a buckle plate and sheet stopping means for stopping a sheet running into said buckle plate in an intake direction, said sheet stopping means being formed by clamping means clamping an incoming sheet in order to stop it.

The design of the buckle plate device according to the invention makes it possible to build buckle plates that are considerably simpler and shorter, since in contrast to the prior art there is no mechanical stop and the clamping means can be positioned in the lower area of the buckle plate. This makes it possible to build more light-weight buckle plates which are easier to handle and require relatively little material, which is less cost-intensive, too. There are no more noise pulses of the sheet hitting against a solid stop rail, the intensity of which has been increasing with a rising machine speed in the prior art. They are replaced by more quiet noise pulses, which do furthermore not increase with the machine speed, of the clamping means with clamping elements acting transversely to the sheet transport direction. Therefore noise protection hoods which require a lot of space and material and are cost-intensive, as necessary in the prior art, can be simplified.

Due to the fact that the sheets do not hit against a stop with their leading edge, there is no damage or marking of the leading edge of the sheets. Therefore it is also possible to process sensitive papers at a higher speed. Likewise there is thus no wave formation in the sheets, which is disadvantageous to the folding quality, and no necessity for a small buckle plate width in the area of the buckle plate behind the clamping means in order to avoid or minimize this wave formation, as well as there is thus no limitation of the processing speed, especially in the case of sheets which are not rigid.

In an advantageous embodiment of the buckle plate device according to the invention the clamping means has, at both sides of the sheet plane of an incoming sheet, first and second clamping elements arranged opposite one another. The first clamping elements are preferably moveable in the direction of the corresponding second clamping elements by a drive from an initial position into a clamping position in order to clamp an incoming sheet. Pairs of first and second clamping elements are preferably spaced apart from one another transversely to the intake direction, wherein it is appropriate to connect the first clamping elements and the second clamping elements, respectively, by a rail in a comb-like manner and to solely drive the first clamping elements jointly by a drive. In this case only a single drive is required for the clamping means.

For a time control of the clamping means at least one sensor may be arranged in or in front of the buckle plate which emits a signal to activate the drive of at least the first clamping elements into the clamping position when an edge or a selected spot, for example, of the print image of an incoming sheet is detected. This makes it possible to electronically activate the folding process either in a controlled manner with respect to sheet edges or with respect to the print image of a sheet or with respect to markings additionally applied to a sheet. Since there is always a fixed time difference of some milliseconds between a sensor signal and the stopping of a sheet, which time difference is constant independently of the sheet transport speed, the sheet intake length from a sensor signal to the stopping of a sheet is displaced with increasing speed. This can be compensated by a selectable hold-back time of the sensor signal. Different folding lenghts can preferably be realized either by different sensor positions, or by no or equal signal delays, or by fixed sensor positions and different signal delays.

It is advantageous to support the clamping elements in a pivotable manner about a pivot axle extending in parallel to the sheet plane and perpendicularly to the intake direction such that they can be pivoted in the outlet direction of the sheet from their clamping position into a release position against the force of a bias means. This is appropriate since thereby the release of the clamping is not time-controlled, but is, just as the stopping of the sheet, controlled by the movement of the sheet. The sheet grasped by the subsequent rollers must be released from the clamping immediately at the onset of the tractive forces of the subsequent rollers in order not to be torn. Not till then the drive moves the first clamping elements back into their initial position, since the drive is given the signal for the back movement not before the sheet is drawn away.

In order to enable a sheet to run in and pass through without being obstructed, the first and second clamping elements are provided with a chamfer at their edge facing the intake opening such that an intake funnel is formed.

The width of the clamping means is preferably more than 60% of the width of the maximum paper format which can be processed in the corresponding buckle plate device. The drive can be arranged at a side of the clamping means or in an intermediate area of the clamping means. The clamping means can be divided up into several portions covering the maximum format width. A folding unit usually has four to six buckle plates, wherein in 90% of the applications only the first and the second buckle plate is actually used as a buckle plate. The other buckle plates are closed by means of sheet shunts, which pass on the sheet. The buckle plate device according to the invention can thus in most cases be used advantageously for the first and second buckle plate. It can however also be attached to each buckle plate. A buckle folding machine usually consists of one to four folding units, wherein the size and the weight of the buckle plates, the sheet speed, the intensity of the folding impetus and the size of required noise protection hoods decrease from the first to the fourth folding unit. For this reason it is appropriate to equip at least the first folding unit, but also the second folding unit with the buckle plate device according to the invention.

An exemplary embodiment of the invention is described hereinafter by means of drawings, wherein FIG. 1 is a schematic cross-sectional view of a buckle plate device comprising clamping means with clamping elements in their initial position at the time when a sheet is running in;

Figure 1:
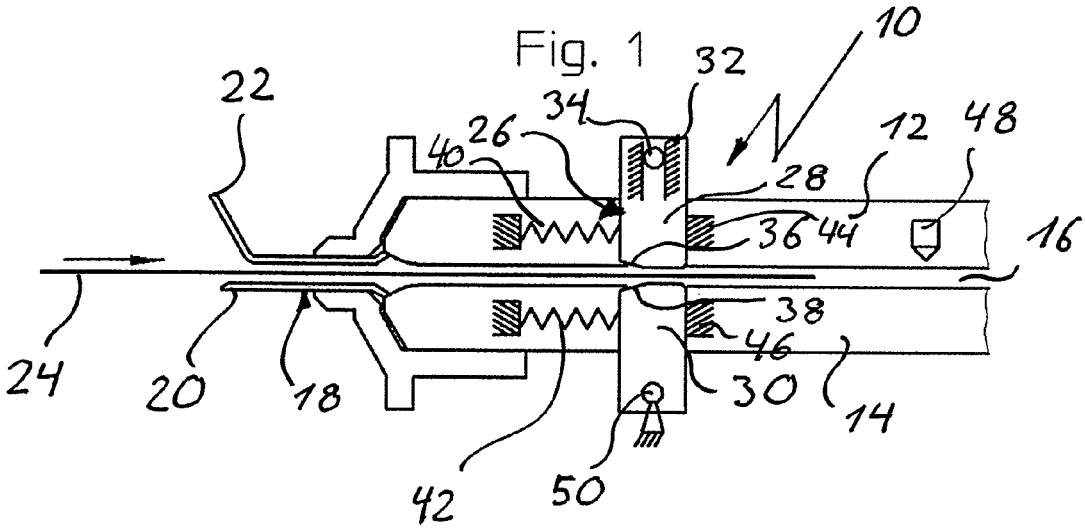

The buckle plate device, such as the buckle plate device known from DE 24 27 850 A1, comprises a buckle plate 10 having several upper buckle plate bars 12 spaced apart from one another in parallel and several lower buckle plate bars 14 spaced apart from one another in parallel below the respective buckle plate bars 12, wherein in the figures due to the cross-sectional representation only one buckle plate bar 12, 14 can be seen. The upper buckle plate bars 12 are spaced apart from the lower buckle plate bars 14, whereby a buckle plate space 16 is formed. At the end on the intake side of the buckle plate bars 12, 14 an intake means 18 is provided which has an upper guide plate 22 and a lower guide plate 20, which are spaced apart from one another in order to form an intake opening aligned to the buckle plate space 16. Through the intake opening 18 a sheet 24 conveyed by intake rollers (not shown) is conveyed in a sheet plane BE into the buckle plate space 16.

Furthermore, at the buckle plate 10 a clamping means 26 is provided which has several upper clamping elements 28, each engaging between two neighbouring upper buckle plate bars 12, and several lower clamping elements 30, each engaging between neighbouring lower buckle plate bars 14, wherein again due to the cross-sectional representation only one clamping element 28 and 30, respectively, is shown. The upper clamping elements 28 as well as the lower clamping elements 30, respectively, are connected in a comb-like manner through a rail (not shown) extending outside the buckle plate bars 12 and 14, respectively.

The clamping elements 30 can be pivoted about a pivot axle 50 fixed on a mount and located outside the buckle plate bars 14 and extend with their free end into the buckle plate space 16. The clamping elements 28 are supported in a pivotable manner about a pivot axle 34 located outside the buckle plate bars 12, wherein the pivot axle 34 is guided such that it can be displaced in a guide 32 approximately at right angles to the sheet plane BE. The clamping elements 28, too, extend with their free end into the buckle plate space 16, wherein the free ends of the clamping elements 28 and 30 are spaced apart from one another when the clamping element 28 is in its initial position shown in FIG. 1. The clamping elements 28, 30 are formed essentially in the shape of a rectangular box and, in their initial position shown in FIG. 1, with their side facing away from the intake side of the buckle plate 10, abut on a stop 44, 46, respectively, such that they are essentially arranged at right angles to the sheet plane BE. The clamping elements 28, 30 are biased by pressure springs 40 and 42, respectively, against the stops 44, 46. In order to simplify the intake of a sheet 24 through the gap between the clamping elements 28, 30, the clamping elements 28, 30 are at their free end on the intake side provided with chamfers 36 and 38, respectively, whereby an intake funnel is formed. Finally, behind the clamping means 26, seen in the sheet intake direction, a sensor 48 is arranged which detects the leading edge of the sheet 24 or a previously determined print image on the sheet 24 and emits a corresponding signal to a stepper motor 54 (FIG. 6), by which the clamping elements 28 are moved in the direction of the clamping elements 30 or away from them.

Figure 6:
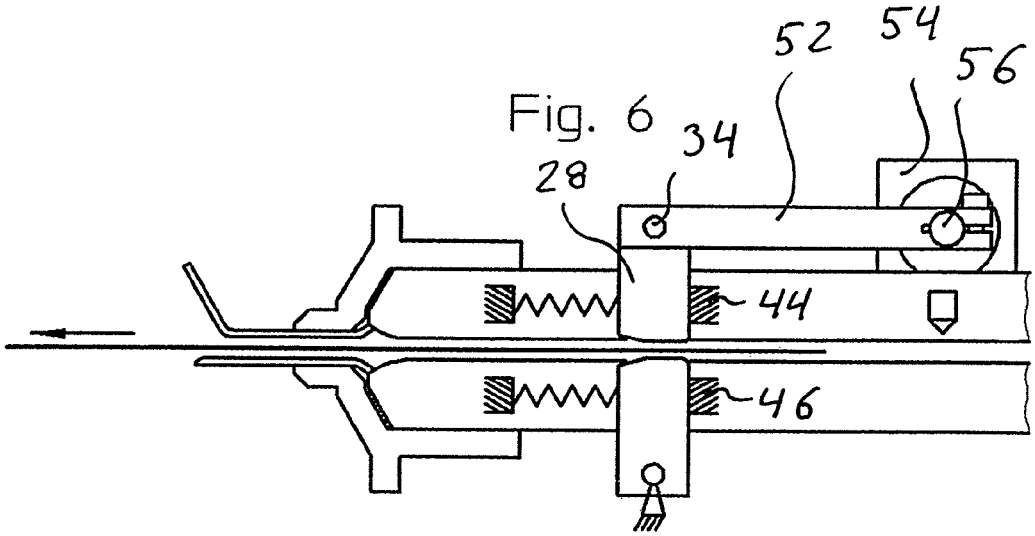
FIG. 6 is the same view as FIG. 5, wherein additionally a stepper motor drive is shown.

As can be seen in FIG. 6, the stepper motor 54 has a drive shaft 56 at which one end of an arm 52 is fixed, wherein at the other end of the arm 52 the pivot axle 34 is supported in a rotatable manner.

FIG. 1 shows the intake of a sheet 24 conveyed by intake rollers (not shown) into the buckle plate 10 when the upper clamping elements 28 are in their initial position spaced apart from the clamping elements 30. The sheet 24 runs through the gap between the clamping elements 28, 30.

Figure 2:
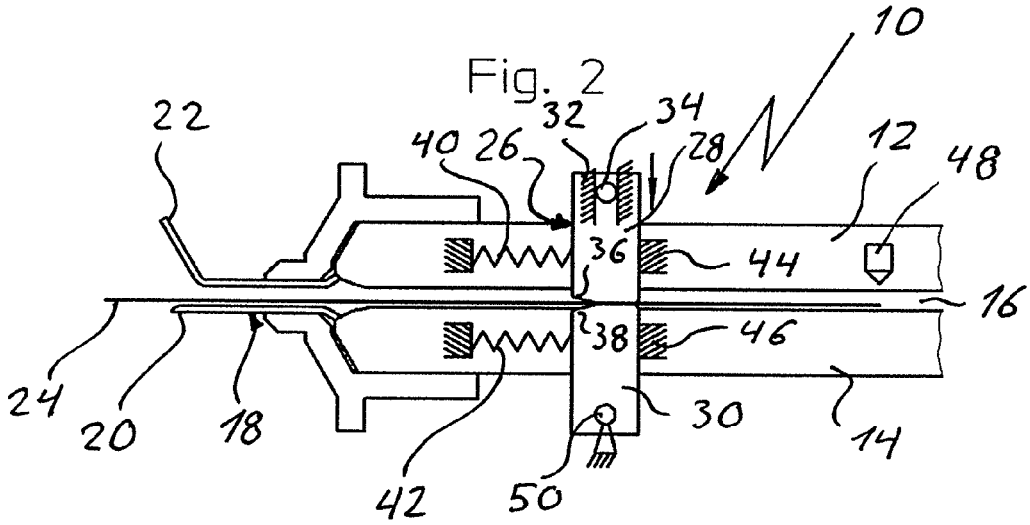
FIG. 2 shows the buckle plate device of FIG. 1, wherein the clamping elements of the clamping means are in a clamping position.

FIG. 2 shows the moment when the front leading edge of the sheet is detected by the sensor 48. As indicated by the arrow, the signal of the sensor 48 activates the stepper motor 54 so that the upper clamping elements 28 are moved in the direction of the clamping elements 30 into a clamping position, whereby the sheet 24 is clamped between the clamping elements 28, 30 and comes to a halt.

Figure 3:
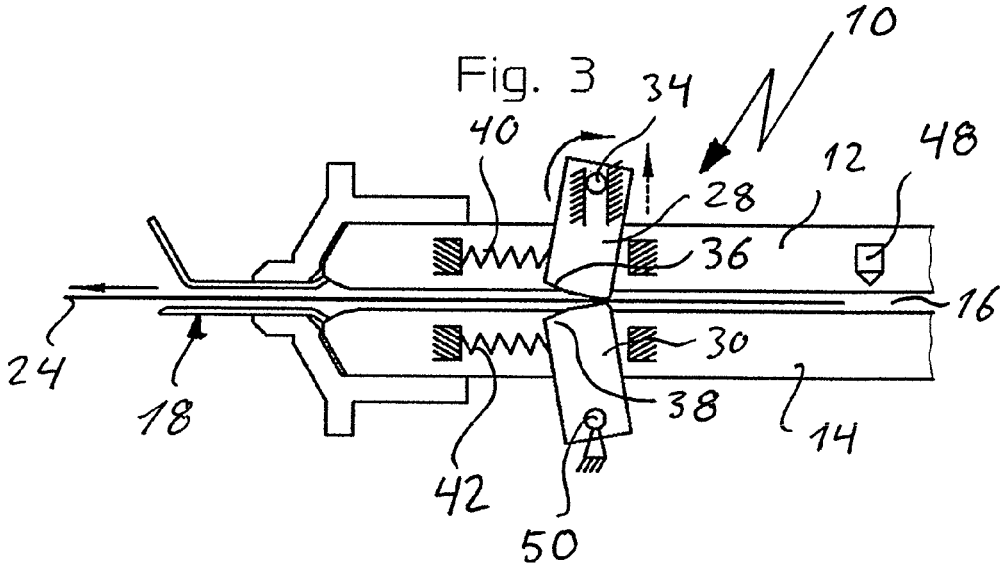
FIG. 3 shows the buckle plate device of FIG. 1 shortly after a sheet has begun to run out.

FIG. 3 shows the buckle plate device at the time when the sheet 24 is grasped by subsequent rollers (not shown), whereby it is conveyed out of the buckle plate 10. Due to this and due to the friction force between the sheet 24 and the clamping elements 28, 30 the clamping elements 28, 30 are pivoted against the bias force of the pressure springs 40, 42 in the outlet direction, and the clamping is automatically released. Hereby it is avoided that the sheet 24 gets torn because of the tractive forces exerted by the subsequent rollers at the time when it is still clamped between the clamping elements 28, 30. When the leading edge of the sheet 24 runs past the sensor 48, a signal is emitted through which the back movement of the stepper motor is activated and the clamping elements 28 are moved back into their initial position.

Figure 4:
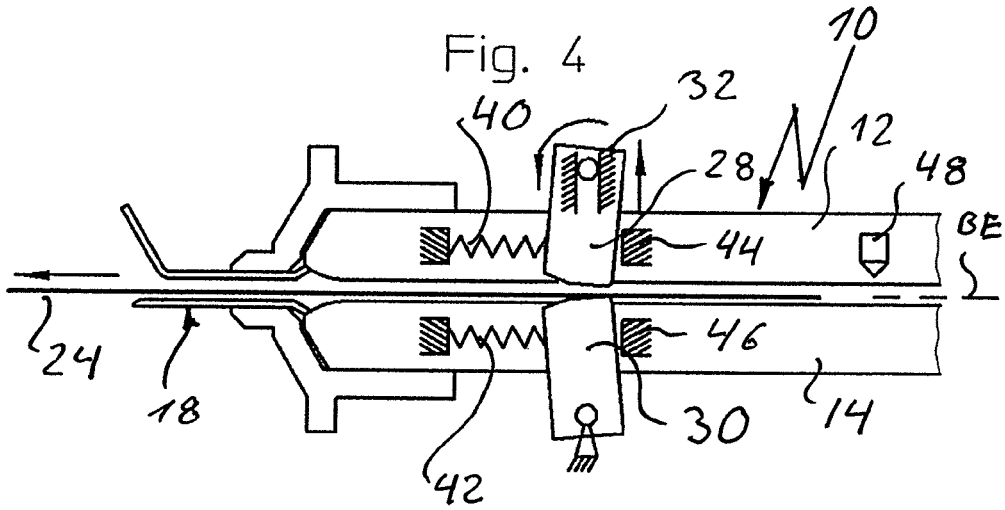
FIG. 4 shows the buckle plate device of FIG. 1, wherein the clamping elements of the clamping means move back to their initial position.

FIG. 4 shows the situation when the upper clamping elements 28 are moved thus far in the direction of their initial position that the sheet 24 is released between the clamping elements 28, 30, so that no more clamping force is exerted on the sheet 24. Because of the spring force exerted by the pressure springs 40, 42 the clamping elements 28, 30 are moved back in the direction of the stops 44, 46.

Figure 5:
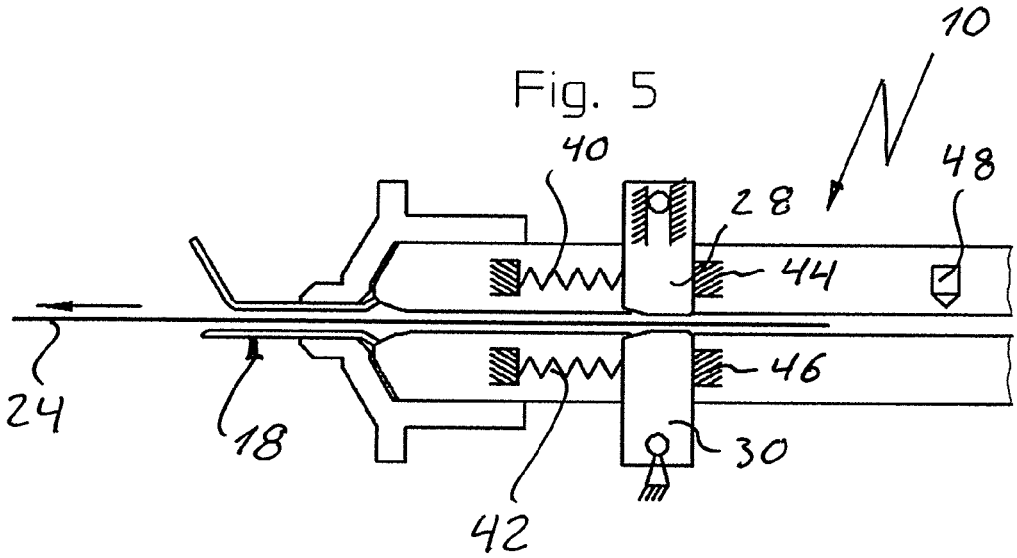
FIG. 5 shows the buckle plate device of FIG. 1, wherein the clamping elements of the clamping means are located in their initial position at the time when a sheet is running out.

FIG. 5 shows the situation when the clamping elements 28, 30 abut on the stop elements 44, 46, the clamping elements 28 are moved back into their initial position and the sheet is conveyed out of the buckle plate 10.

The invention is not to be considered as limited to the represented embodiment. A stepper motor with one-sided or two-sided axle can be used as a drive. Instead of the stepper motor with an arm shown in FIG. 6 a linear motor can be provided which adjusts the clamping elements exactly vertically to the sheet plane. In the embodiment shown only the upper clamping elements 28 can be moved in the direction of the lower clamping elements 30. It is likewise conceivable that the lower clamping elements 30 can be moved in the direction of the upper clamping elements 28 or that both clamping elements 28, 30 are moveable towards one another. The sensor 48 can be arranged such that it is fixed or slideable. Different folding lenghts can preferably be realized either by different sensor positions, or by no or equal signal delays, or by fixed sensor positions and different signal delays. The clamping elements can also be arranged such that they are not pivotable even if this requires a higher level of control technology, in order to make sure that no more clamping force is exerted on the sheet when tractive forces act on it through the subsequent rollers. It is also possible to drive the clamping pairs by different drives and to activate them at different times in order to have an influence on slant folding.

The invention claimed is:

1. A buckle plate device for a folding machine comprising a buckle plate and sheet stopping means for stopping a sheet running into said buckle plate in an intake direction, said sheet stopping means being formed by clamping means clamping an incoming sheet in order to stop it; wherein said clamping means comprises at least one pair of first and second clamping elements arranged opposite one another at both sides of a sheet plane of an incoming sheet, wherein at least said first clamping element of said at least one pair can be moved towards said second clamping element for clamping an incoming sheet by drive means from an initial position to a clamping position and for an unobstructed intake of a subsequent sheet back into said initial position; and wherein said clamping elements are supported in a pivotable manner about a pivot axle extending in parallel to said sheet plane and perpendicularly to said intake direction such that they can be pivoted from a clamping position thereof into a release position against the force of bias means in an outlet direction.

2. The device according to claim 1, wherein said clamping means comprises several pairs of first and second clamping elements spaced apart from one another transversely to said intake direction.

3. The device according to claim 2, wherein said first clamping elements and said second clamping elements are in each case connected by a rail in a comb-like manner, wherein at least said first clamping elements of the pairs are jointly driven by said drive means.

4. The device according to claim 1, wherein in or in front of said buckle plate at least one sensor is arranged which emits signals to activate said drive means to move at least said first clamping elements into said clamping position when an edge of an incoming sheet or a selected spot on said incoming sheet is detected.

5. The device according to claim 4, wherein said at least one sensor emits signals to activate said drive means to move at least said first clamping elements into said initial position when an edge of an outgoing sheet or a selected spot on said outgoing sheet or on said clamping means is detected.

6. The device according to claim 1, wherein each of said first and second clamping elements has a chamfer formed at an edge thereof facing said intake opening such that an intake funnel is formed.

* * * * *